US005454201A

United States Patent [19]

Slonim

[11] Patent Number: 5,454,201

[45] Date of Patent: Oct. 3, 1995

[54] PREFABRICATED TRUSS

[76] Inventor: Jeffrey M. Slonim, P.O. Box 3098, Evergreen, Colo. 80439

[21] Appl. No.: 980,495

[22] Filed: Nov. 23, 1992

[51] Int. Cl.[6] ..... E04B 1/32

[52] U.S. Cl. ..... 52/639; 52/262; 52/92.1

[58] Field of Search ..... 52/639, 642, 643, 52/90.1, 91.3, 92.1, 92.2, 93.1, 93.2, 644, 640, 262, 263, 22; D25/22, 29

[56] References Cited

U.S. PATENT DOCUMENTS

| | | | |
|---|---|---|---|
| 590,227 | 9/1897 | Isham . | |
| 2,604,060 | 7/1952 | Hansen . | |
| 2,666,507 | 1/1954 | Ruark . | |
| 2,687,102 | 8/1954 | Rongved . | |
| 2,709,975 | 6/1955 | O'C. Parker . | |
| 2,762,084 | 9/1956 | Singer et al. . | |
| 2,764,107 | 9/1956 | Niswonger et al. . | |
| 3,010,547 | 11/1961 | Foster | 52/639 |
| 3,019,861 | 3/1959 | Rasch et al. | 52/93.1 |
| 3,067,544 | 12/1962 | Willatts . | |
| 3,421,270 | 1/1969 | Chaney . | |
| 3,605,355 | 9/1971 | Solesbee . | |
| 3,862,533 | 1/1975 | Fuss . | |
| 3,902,280 | 9/1975 | Spoar et al. . | |
| 4,294,050 | 10/1981 | Kandel | 52/93.2 |
| 4,312,160 | 1/1992 | Wilbanks et al. . | |
| 4,437,273 | 3/1984 | Helfman | 52/643 |
| 4,516,363 | 5/1985 | Beaulieu et al. | 52/92.1 |
| 4,748,784 | 6/1988 | Dividoff et al. | 52/639 |

FOREIGN PATENT DOCUMENTS

| | | | |
|---|---|---|---|
| 87504 | 12/1920 | Switzerland | 52/93.2 |

OTHER PUBLICATIONS

A copy of translation of Swiss Patent No. 87,504.

*Primary Examiner*—Carl D. Friedman
*Assistant Examiner*—Kien Nguyen
*Attorney, Agent, or Firm*—Harness, Dickey & Pierce

[57] ABSTRACT

Prefabricated Truss includes a header for use above an opening in a wall such as for a garage door opening. The truss extends below the level of the top king plate of adjacent walls to a level where the header would normally be found. By including the header in the prefabricated truss, labor and materials are saved.

15 Claims, 2 Drawing Sheets

PREFABRICATED TRUSS

BACKGROUND OF THE INVENTION

This invention relates to prefabricated trusses and, more particularly, to prefabricated trusses for use in structures such as residential and commercial buildings.

Trusses, like many parts of the structure, have been prefabricated for a number of years. The motivating factor behind the use of prefabricated trusses is to produce a structurally sound building while saving labor and materials. By prefabricating the truss, at a location other than the actual building site or other than in place, money can be saved due to more efficient use of labor, specialized machines, economy of scale, etc. Prefabricated trusses have generally taken the form of a triangle, two sides of which will define the roof surface, the third side to rest upon the top plate or king plate of the structures walls. As such, the truss is separate from and supported upon the walls with a bottom chord level with the top of the walls.

Where a wall, either exterior or interior, is designed to have an opening, typically the wall would be framed and a beam or header placed across the uppermost edge of the opening and integrated with the wall either by attachment to surrounding studs and possibly with the addition of cripple studs. The area above the header would be finished off with a sill or king plate running the length of the wall. A prefabricated truss placed on top of the wall would usually have a bottom most beam or chord that would be parallel to and lie against the king plate. As such, the truss was not integrated with the wall but rather attached at the generally linear interface of the king plate with the bottom chord of the truss.

Other prefabricated trusses may not have a bottom side or chord level with the wall but, as in the case of a scissors truss, be likewise designed to be secured to the top of a structurally complete wall.

SUMMARY OF THE INVENTION

The invention relates to a prefabricated truss which provides high structural strength while further reducing the overall cost and time of assembly of the structure as a whole.

According to the invention, the prefabricated truss includes a header as part of the truss designed to be integrated with a wall of the structure whereby the header serves as the uppermost beam for an opening in the wall.

According to a further feature of the invention, the header of the truss may descend below the top plate of the walls further integrating the truss into the structure of the wall.

According to a further feature of the invention, the header may be composed of separate chords assembled at angles with respect to one another to duplicate the proper outline of the uppermost edge of an irregularly spaced opening.

According to a further feature of the invention, the prefabricated truss may also include a ceiling joist for aid in locating the truss with respect to the walls and speeding assembly of the remainder of the structure such as the ceiling.

According to another feature of the invention, a single prefabricated truss can include a plurality of headers where the wall adjacent the truss is designed to have a plurality of openings.

The integration of the header into the roof truss further ties together the roof truss to the structural wall for increased structural benefits. The prefabrication aspect allows greater economy through more efficient utilization of skilled and unskilled labor and the use of machinery. The prefabrication of the truss can also save labor costs especially in areas where local conditions such as inclement weather put time spent at the job site at a premium. By integrating the header into the roof truss, materials can also be saved by avoiding duplication or addition of certain elements such as a portion of the king plate and/or structural header material.

DETAILED DESCRIPTION OF THE DRAWINGS

DETAILED DESCRIPTION OF THE PREFERRED EMBODIMENT

Figure 1:
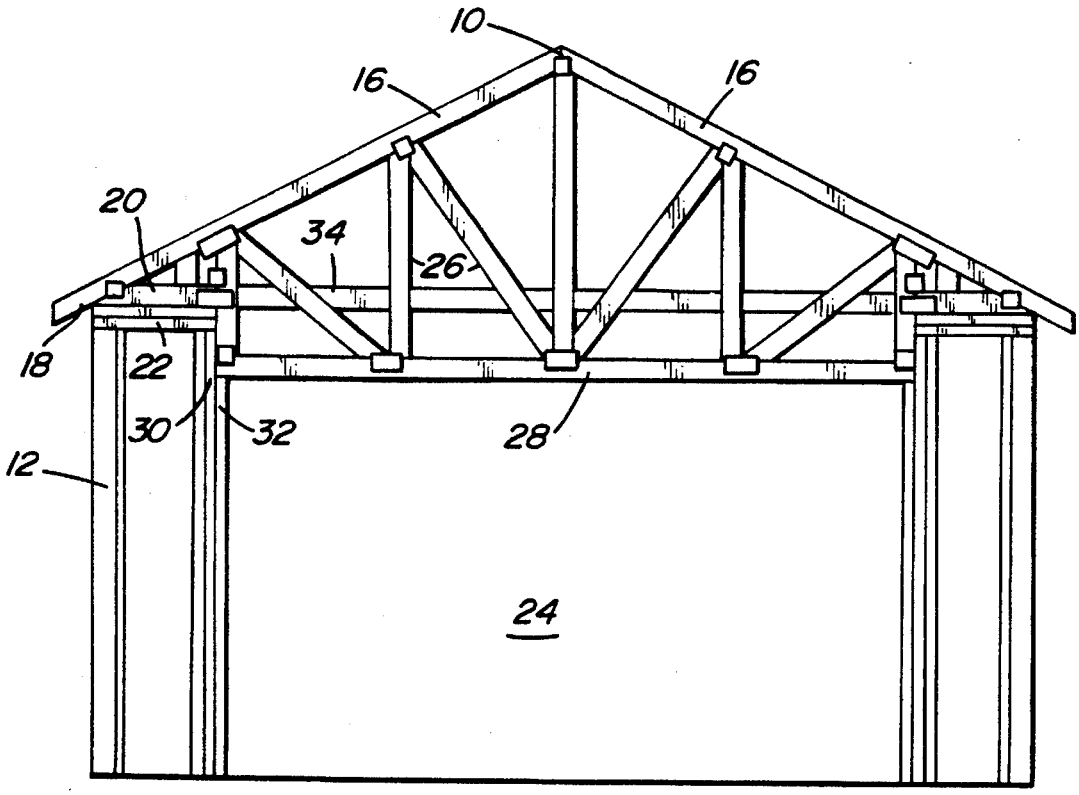
FIG. 1 is an elevational view of a framed wall with the invention in place.

Turning to FIG. 1, an embodiment of the present invention is shown. A roof truss with integral header 10, is shown mounted on and integrated into wall 12 of a structure. Wall 12 may be an exterior or interior wall. FIG. 1 illustrates generally the use of the roof truss with integral header in an application such as an opening 24 for the door in a two car garage. The truss includes a pair of upwardly and inwardly converging roof rafters 16 which form a roof defining surface. The truss may in some circumstances have only one rafter such as in a mono-truss. Once a plurality of trusses have been installed for the structure, the roof rafters will form one or more planes upon which roofing materials will be placed in a manner well known in the art, e.g. sheathing, underlayment, and shingles. Top chord or roof rafter 16 may extend beyond the edge of wall 12 as shown or form a tail or an eave 18, or alternately may be truncated at wall 12 depending upon the architecture or building requirements.

Horizontal bottom chords or king plate chords 20 are attached to rafter 10. King plate chords 20 serve to locate truss 10 upon top sill or king plate 22 of the structural walls and provide a structure for attaching the truss to the walls of the structure. King plate chords also aid in properly locating the prefabricated truss relative to wall 12 and opening 24.

Webbing 26 is provided to further reinforce the truss especially against compressive forces on the rafters 16 such as dead or live loads on the roof. The webbing can take one of the various forms known to those skilled in the art, such as W webbing or other forms of cross bracing and may vary from application to application depending on the amount and type of reinforcement desired.

Header 28 is placed below the level of the king plate chords in the same location where a header of conventional construction would be placed. King plate chord 20 generally ends at a vertical line where header 28 begins and as such does not necessarily overlap header 28. The header is integrated into the prefabricated truss by attachment with webbing 26 and integrated into the wall structure by attachment, such as by nailing into studs 30 of wall 12. Cripple studs 32 may be added for further structural reinforcement, if desired. Joist 34 may be added as an indexing and construction aid for locating and attaching further materials, such as the ceiling and/or flooring boards and indexing the level of the floor and/or ceiling relative to the truss. Joist 34 may be prefabricated with the truss, i.e. assembled off site or other than in place on the structure or may be added once the truss has been integrated with the structure.

Figure 2:
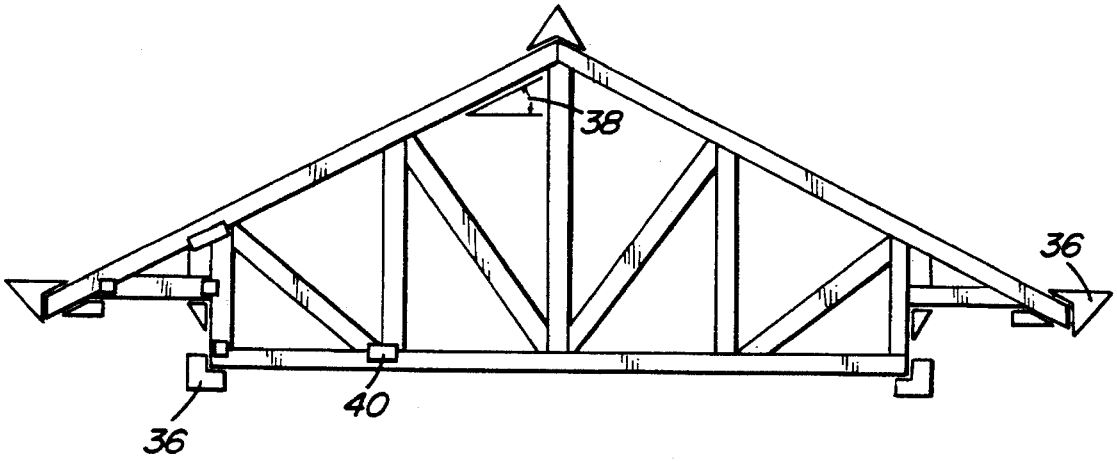
FIG. 2 is an elevational view of a truss such as shown installed in FIG. 1.

FIG. 2 illustrates the truss of FIG. 1 separate from the structure and the method of making the truss. Once the dimensions of the opening for which a header is required are known and location of that opening relative to the walls and roof joists are known, templates and/or jigs 36 can be constructed to precisely fix angles and/or separate locations of the truss relative to one another by fixing the templates and/or jigs in their proper relative location on a structure such as a floor or work table. The use of prefabrication in general causes reproduceability to be enhanced and truss to truss variation reduced resulting in higher quality parts at a time savings. Regardless of the number of pieces produced, the use of the templates and/or jigs 36 enhances accuracy, such as enhanced squareness and more precise dimensions. The jigs are sized and placed in a manner familiar to those skilled in the art, including the use of jigs and/or templates at critical angular or linear dimensions. The truss may be prefabricated by cutting properly sized dimensional lumber, e.g. 2×4's, 2×6's 2×8's, etc. to the specified linear dimension. The cut lumber is then placed flat within the jig in the plane of the truss and the templates. The dimensions of the lumber are checked to match the linear dimensions required by the jigs and/or templates and that angles such as pitch 38 of the roof is correct. Webbing such as W or diagonal bracing may be inserted as required. Nailing plates 40 may be used at the intersections of the component lumber to affix the separate pieces into a truss. The size and location of the nailing plates is to be selected in a manner well known to those skilled in the art. FIG. 2 illustrates a relative sizing and placement for a typical truss according to the invention for use in a two car garage.

Figure 3:
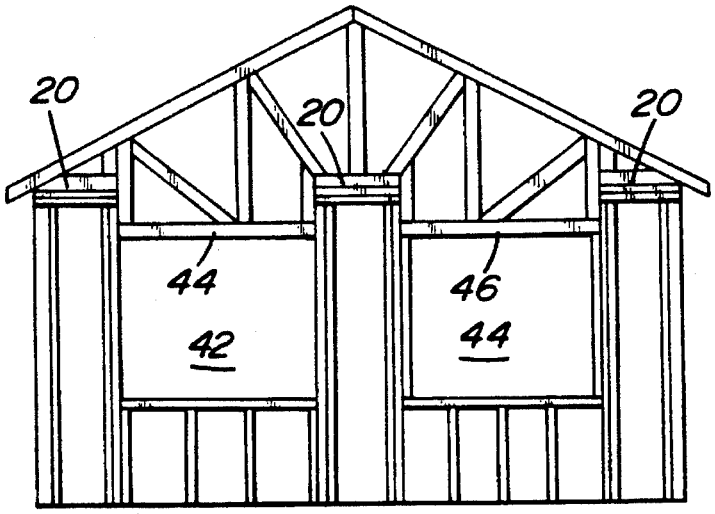
FIG. 3 is an elevational view of an embodiment of a truss.

FIG. 3 illustrates an alternate embodiment of the invention for use where a wall requires a plurality of openings, such as at locations 42 and 44. Each opening has its own header 44, 46 integral with the truss. The area adjacent to the opening where a wall will be framed is provided with king plate chord 20.

Figure 4:
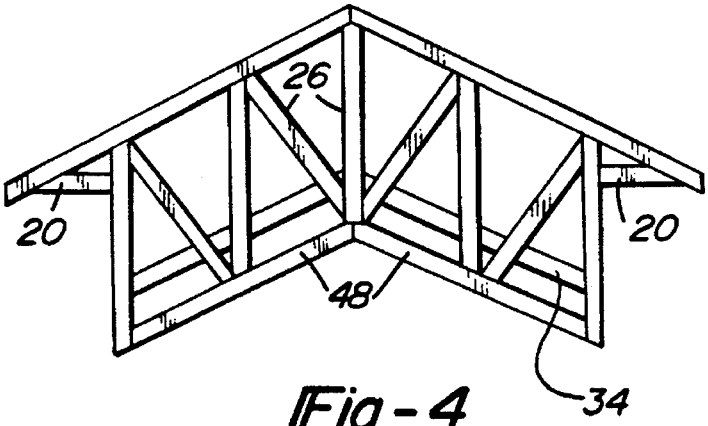
FIG. 4 is an elevational view of an embodiment of a truss.

FIG. 4 illustrates an alternate embodiment of the invention for use with an irregularly shaped opening. FIG. 4 illustrates the use of the invention with a cathedral window opening. The top opening is non-linear and consists of a plurality of chords 48 to form a header to match the upper edge of the opening as architecturally designed. Webbing 26 is designed accordingly to brace the truss assembly.

Figure 5:
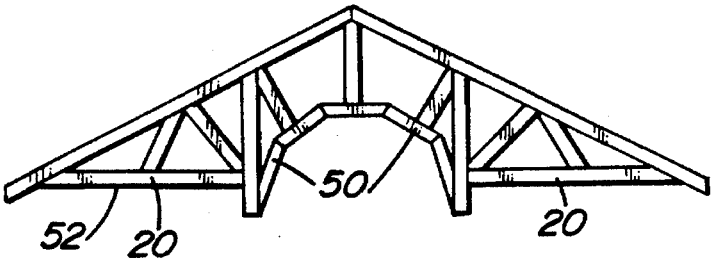
FIG. 5 is an elevational view of an embodiment of a truss.

FIG. 5 illustrates an embodiment of the invention for use with another irregularly shaped opening which, as shown, is an arched top or semi-circular window. The header consists of a plurality of chords 50 sized and located to match the architecturally designed upper edge of the opening. Depending on the placement of the opening by the architect, the header may extend above and below the level 52 defined by king plate chords 20.

While the above detailed description describes the preferred embodiment of the present invention, it will be understood that the present invention is susceptible to modification, variation and alteration without deviating from the scope and fair meaning of the subjoined claims.

What is claimed:

1. A truss in combination with a wall, the wall defining a plane, comprising:

a pair of upwardly and inwardly converging roof rafters;

at least one generally horizontally extending king plate chord placed on the wall, said king plate chord defining king plate level;

header means placed below said king plate level spanning an opening in the wall, wherein the opening in the wall is in the plane of the wall;

web means disposed between said roof rafters and said header means for reinforcing said rafters.

2. The prefabricated truss and wall combination of claim 1 wherein said king plate chord does not vertically overlap said header means.

3. The prefabricated truss and wall combination of claim 2 wherein said header means further comprises a plurality of beams separated by at least one king plate chord as headers over a plurality of openings in said wall.

4. The prefabricated truss and wall combination of claim 1 wherein said header means comprises a pair of upwardly and inwardly converging generally straight beams as a header over said opening wherein said opening is a cathedral window opening.

5. The prefabricated truss and wall combination of claim 1 wherein said header means further comprises a single horizontal beam as a header over said opening in said wall.

6. The prefabricated truss and wall combination of claim 1 wherein said header means is secured to said wall at a point below said king plate level and extends to a point above said king plate level.

7. The prefabricated truss and wall combination of claim 1 further comprising ceiling joint means.

8. A prefabricated truss assembly in combination with a first wall, said first wall defining a plane, comprising:

roof rafter means;

web means disposed below said rafter means for reinforcing said rafter means;

king plate chords vertically positioning said truss with respect to a second wall in a second plane and defining a king plate level;

header means secured to said web means for use as a header spanning an opening in said first wall non-coplanar with said second wall with said first wall.

9. The prefabricated truss and wall combination of claim 8 wherein said header means extends to a point below said king place level.

10. The prefabricated truss and wall combination of claim 8 wherein said header means further comprises:

a pair of upwardly and inwardly converging beams as the header of said opening herein said opening is a cathedral window opening.

11. The prefabricated truss and wall combination of claim 8 wherein said header means is disposed entirely below said king plate level.

12. The prefabricated truss and wall combination of claim 8 wherein said header means further comprises:

a plurality of headers for a plurality of openings in said wall each of said headers separated from any adjacent header by king plate chords.

13. The prefabricated truss and wall combination of claim 8 wherein said header means comprises a beam as the header in said wall of said opening wherein said opening is for a two car garage opening.

14. The prefabricated truss and wall combination of claim 8 wherein said header means comprises:

a plurality of chords as the header over said opening wherein said opening is an irregularly spaced opening in said wall.

15. A prefabricated truss in combination with a first wall, said first wall defining a first plane, comprising:

rafter means for defining a roof surface;

web means disposed below said rafter means for reinforcing said rafter means;

king plate chord placed upon a top sill of a second wall in a second plane;

header means secured to said web means and disposed below said king plate chord for defining the top header of an opening in said first wall in said first plane.

* * * * *

UNITED STATES PATENT AND TRADEMARK OFFICE

CERTIFICATE OF CORRECTION

PATENT NO. : 5,454,201

DATED : October 3, 1995

INVENTOR(S) : Jeffrey M. Slonim

It is certified that error appears in the above-indentified patent and that said Letters Patent is hereby corrected as shown below:

Col. 4, line 46, delete "place" and substitute therefor –plate–.
Col. 4, line 50, delete "herein" and substitute therefor –wherein–.

Signed and Sealed this

Second Day of January, 1996

*Attest:*

BRUCE LEHMAN

*Attesting Officer*

*Commissioner of Patents and Trademarks*